US011028649B2

(12) United States Patent
Loikkanen

(10) Patent No.: US 11,028,649 B2
(45) Date of Patent: Jun. 8, 2021

(54) RAISE BORING HEAD FOR ROTARY BORING

(71) Applicant: SANDVIK INTELLECTUAL PROPERTY AB, Sandviken (SE)

(72) Inventor: Joona Loikkanen, Sandviken (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 15/578,673

(22) PCT Filed: May 9, 2016

(86) PCT No.: PCT/EP2016/060254
§ 371 (c)(1),
(2) Date: Nov. 30, 2017

(87) PCT Pub. No.: WO2016/192928
PCT Pub. Date: Dec. 8, 2016

(65) Prior Publication Data

US 2018/0223600 A1 Aug. 9, 2018

(30) Foreign Application Priority Data

Jun. 1, 2015 (EP) ..... 15170073

(51) Int. Cl.
*E21B 10/10* (2006.01)
*E21B 7/28* (2006.01)
*E21B 10/28* (2006.01)

(52) U.S. Cl.
CPC ..... *E21B 10/10* (2013.01); *E21B 7/28* (2013.01); *E21B 10/28* (2013.01)

(58) Field of Classification Search
CPC ..... E21B 10/10; E21B 10/28; E21B 7/28
See application file for complete search history.

(56) References Cited

U.S. PATENT DOCUMENTS

| | | | | |
|---|---|---|---|---|
| 3,638,740 | A * | 2/1972 | Justman | E21B 10/28 175/344 |
| 3,858,667 | A | 1/1975 | Goodfellow | |
| 4,142,598 | A | 3/1979 | Maxsted | |
| 4,179,000 | A * | 12/1979 | Mitchell | E21B 7/28 175/344 |
| 4,228,863 | A | 10/1980 | Liljekvist et al. | |
| 4,301,876 | A | 11/1981 | Harrison et al. | |
| 4,381,038 | A | 4/1983 | Sugden | |
| 4,386,670 | A | 6/1983 | Westermark | |
| 4,399,879 | A | 8/1983 | Liljekvist et al. | |
| 4,456,082 | A * | 6/1984 | Harrison | E21B 7/28 175/384 |
| 4,832,135 | A | 5/1989 | Walk et al. | |
| 2011/0079440 | A1 | 4/2011 | Buske et al. | |

FOREIGN PATENT DOCUMENTS

| | | | |
|---|---|---|---|
| GB | 2022174 | A | 12/1979 |

* cited by examiner

*Primary Examiner* — D. Andrews
(74) *Attorney, Agent, or Firm* — Corinne R. Gorski

(57) ABSTRACT

A raise boring head for rotary boring in rock having a main body mountable at a drive shaft in which a mount face provides a supporting surface for a plurality of saddles that mount, in turn, respective roller cutters. At least one guide block is attached to the main body to project upwardly from the mount face and includes at least one guide face to facilitate the transport of cut material away from the mount face.

10 Claims, 6 Drawing Sheets

RAISE BORING HEAD FOR ROTARY BORING

RELATED APPLICATION DATA

This application is a § 371 National Stage Application of PCT International Application No. PCT/EP2016/060254 filed May 9, 2016 claiming priority to EP Application No. 15170073.9 filed Jun. 1, 2015.

FIELD OF INVENTION

The present invention relates to a raise boring head and in particular, although not exclusively, to a boring head having a mount face to mount a plurality of roller cutters with at least one guide block projecting from the mount face to facilitate the transport of cut material away from the mount face.

BACKGROUND ART

Raise boring operations may be performed in a mine or other underground works to provide access or to create ventilation shafts. The technique typically involves drilling a small diameter pilot hole from a first location to a second location. Once completed, the pilot bit is removed and a large diameter raise boring head is mounted at the drive shaft, with the shaft having a diameter corresponding to that of the pilot hole. The raise head is rotated and drawn upwardly along the pilot hole so as to enlarge the initial hole to the desired diameter.

Raise boring apparatus is accordingly subject to extreme operating forces and high-performance components are required to endure the harsh working environment and the physical and mechanical demands during cutting. The raise boring head includes replaceable roller cutters distributed over a mount face of the head that act to disintegrate the rock as they rotate independently. Accordingly, the distribution and configuration of the cutters at the boring head may be adapted in an attempt to maximise cutting performance whilst extending, as far as possible, their operational lifetime. Conventional raise bore apparatus is described in U.S. Pat. Nos. 4,228,863 and 4,386,670.

One problem with conventional boring heads is the accumulation of cut debris at the region around the roller cutters. Regrinding of accumulated debris impedes cutting efficiency and accelerates cutter wear. U.S. Pat. No. 4,179,000 describes a raise boring head having a generally conical main plate to mount the roller cutters in an attempt to prevent the build-up of cuttings and provide a self-cleaning head. However, via the conical mounting face, the roller cutters are configured to engage the rock at different respective axial height positions (relative to the drive shaft) and this is disadvantageous for a number of reasons. In particular, differential cutter wear necessitates interchange or premature replacement of the radially innermost cutters that are subject to greater stresses and compressive forces. Additionally, localised debris accumulation at the region of the saddles remains problematic and affects certain cutters of the array depending upon their position at the mount face. Accordingly, what is required is a raise boring head that addresses the above problems.

SUMMARY OF THE INVENTION

It is an objective of the present invention to provide a raise boring head for rotary boring that is optimised for cutting efficiency including in particular maximising the boring rate whilst extending, as far as possible, the service lifetime of the roller cutters. The objectives are achieved by providing a raise boring head that greatly facilitates the transport of cut material away from the active cutting face of the head to avoid debris accumulation at the region around, between or to the lateral sides of the roller cutters. Advantageously, the subject invention provides a raise boring head in which a face of a body that mounts the roller cutters comprises at least one or a plurality of guide blocks that project from the mount face. The guide blocks each comprise at least one guide surface being aligned transverse to the mount face of the body to facilitate the rearward transport of cut material during boring. Optionally, the body of the boring head may comprise one or a plurality of open channels extending axially through the body from the mount face to a rear face with a corresponding guide block positioned immediately adjacent the open end of the channel so as to direct or funnel cut material into the channel to fall under gravity downwardly away from the cutters.

According to a first aspect of the present invention there is provided a raise boring head for rotary boring in rock comprising: a body mountable at a drive shaft, the body having a mount face to extend radially outward from the shaft; a plurality of saddles provided at the mount face to rotatably mount respective roller cutters at the body; characterised by: at least one guide block attached to the body to project from the mount face at a position adjacent or spaced apart from the saddles, the guide block having at least one guide face aligned transverse to the mount face to facilitate the transport of cut material away from the mount face, wherein the guide block is separate to and formed non-integrally with the saddles.

Reference within this specification to the 'mount face' of the body encompasses a surface region of the body that is aligned generally perpendicular to the drive shaft and accordingly a central axis extending through the boring head and the drive shaft. The mount face may however be aligned transverse to the central axis so as to be inclined or declined relative to the drive shaft. Additionally, the mount face may be formed as a generally planar surface region having one or a plurality openings or holes that represent open ends of the debris flow channels that extend axially through the body from the mount face to a rear face. The mount face therefore may be formed as sections or regions of a grid or lattice structure that support the saddles and roller cutters.

Reference within this specification to the 'body' encompasses a raise boring head that may be extendable and formed as a modular, segmented reaming head. Alternatively, the boring head may be formed as an integral reaming head in which a single body is mounted directly to the drive shaft. Where the raise boring head is extendable, the drive shaft is mounted at the extension bodies indirectly.

Preferably, the roller cutters and saddles are mounted at the head such that the uppermost cutting region of the cutters are aligned at the same axial height (relative to the drive shaft) and separation distance from the mount face. Such an arrangement is advantageous to promote uniform wear of the cutters at the different radial positions on the mount face.

Optionally, the guide face is generally planar and inclined relative to the mount face. Optionally, the guide face may be curved relative to the mount face or comprise a curved region. The inclined or curved mount face acts to provide a surface over which the cuttings can pass (slide) under gravity as they are cut and ejected from the rock face by the rotating cutters. The inclination or curvature also acts to direct the cuttings to a particular discharge location such as over an inner or outer peripheral edge of the body or through an open channel extending axially through the body.

Preferably, the boring head further comprises at least one attachment bolt to secure the guide block to the mount face. Such an arrangement is advantageous to allow convenient and adjustable interchange and potential repositioning of the guide block(s) at the mount face to suit particular distributions of roller cutters at the body. For example, it may be desirable for a user to adjust the position of one or more guide blocks following a period of initial boring and the observation of any particular debris accumulation zones that may be dependent upon the rock type, the orientation of the boring and any other factors such as variations in the roller cutter configuration or stratum. Preferably each of the saddles are secured to the mount face via attachment bolts that are separate and independent to the attachment of the at least one guide block to the mount face via at least one respective attachment bolt.

Optionally, the guide blocks may be secured to the mount face by a weld material. Additionally, the guide blocks may be secured by any other permanent or reasonable attachment mechanisms including locking pins, tongue and groove arrangements, twist lock engagements, bayonet fixings etc.

Preferably, the guide block projects from the mount face by a distance that is less than a distance by which at least some of the saddles project from the mount face. Preferably, the guide block projects from the mount face by a distance that is less than a distance by which the closest neighbouring saddle to the guide block projects from the mount face. Optionally, at least some of the saddles may be recessing into the mount face. More preferably, the guide block projects from the mount face by a distance that is less than a distance by which each of the roller cutters project from the mount face. Such an arrangement is advantageous to avoid direct contact with the rock and accordingly the premature wear of the guide block. Preferably, the at least one guide block comprises a height that is less than half of the height of a saddle such that the roller cutters are mounted to stand proud of the guide blocks. Optionally, the at least one guide block projects from the mount face by a distance that is 10 to 50%, 15 to 45% or 25 to 40% of a distance by the saddles project from the mount face. Additionally, the at least one guide block may project from the mount face by a distance that is 10 to 50%, 15 to 45% or 25 to 40% of a distance by the roller cutters project from the mount face.

Preferably, the boring head comprises one or a plurality of open channels extending axially through the body from the mount face to a rear face. Preferably, the guide block or a plurality of guide block are positioned at the mount face adjacent an open end of the channel(s) to deflect cut material into the channel for transport from the mount face to the rear face. Optionally, a single guide block may be positioned laterally to one side of each open end of the channel or a plurality of guide blocks may be positioned adjacent the channel open end. Optionally, the guide block may be positioned at or towards a perimeter edge of the mount face representing the radially outermost region of a boring head. Optionally, the guide block may be positioned at a radially inner region of the mount face adjacent the drive shaft. Such configurations can accordingly be optimised to maximise the through transport of cuttings away from the mount face at zones where debris accumulation may be problematic due to a particular distribution of roller cutters at the body. It is preferable that the guide blocks are positioned at the mount face circumferentially or radially between the saddles where the saddles may be distributed at the same or different respective circumferential and radial spacing relative to one another. Optionally, the guide blocks may be positioned asymmetrically or symmetrically at the mount face with respect to the distribution of roller cutters (and saddles).

Optionally, where the boring head is modular, the body may comprise a main body (or hub) and at least one extension body removably mounted to a lateral side of the main body, the extension body having a corresponding mount face to provide a radial extension of the mount face of the main body. Optionally, the boring head may comprise the same or different extension bodies mountable at the lateral sides of the main body. Optionally, the boring head comprises a plurality of a first type of extension bodies and a plurality of a second type of extension bodies so as to radially extend the mount face and the operative cutting diameter of the boring head. Accordingly, the present raise boring head may be extendable and may be formed as a modular, segmented reaming head. Alternatively, the boring head may be formed as an integral reaming head in which a single body mounts a plurality of roller cutters and one or a plurality of guide blocks.

Optionally, where the boring head is segmented or extendable via one or more extension bodies, the boring head may comprise a guide block or a plurality of guide blocks positioned at the mount face of the main body and/or the extension body radially inside or radially outside the saddles. Such a configuration facilitates the deflection of cut material away from the mount face at all regions of the boring head including radially inner and radially outer sections.

As will be appreciated, the guide block according to the subject invention may comprise any geometry so as to provide a guide face that is aligned transverse to the mount face of the boring head. Optionally, the at least one guide block may be formed as a triangular prism having a single or dual guide face extending from the apex of the guide block. Optionally, the guide block is generally wedge shaped and is formed as a single piece component. Optionally, the guide block comprises one or a plurality of through bores to receive attachment bolts for mounting the guide block to the mount face. Where the guide block is formed as a triangular prism, a through bore may be formed through each of the two guide faces of the prism. Optionally, the guide face may be planar, curved, profiled or comprise channels or directing fins to facilitate the directing of material from the cutting face. Optionally, the guide blocks may be formed from a metal or metal alloy and may comprise a wear resistant, low friction coating on the guide face to facilitate debris transport.

According to a second aspect of the present invention there is provided boring apparatus comprising a raise boring head as claimed herein.

According to a third aspect of the present invention there is provided a method of raise boring comprising providing a self-cleaning raise boring head in which cut material is transported away from the mount face via a plurality of guide blocks formed non-integrally with the saddles and being attached to the mount face independently of the corresponding attachment of the saddles.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
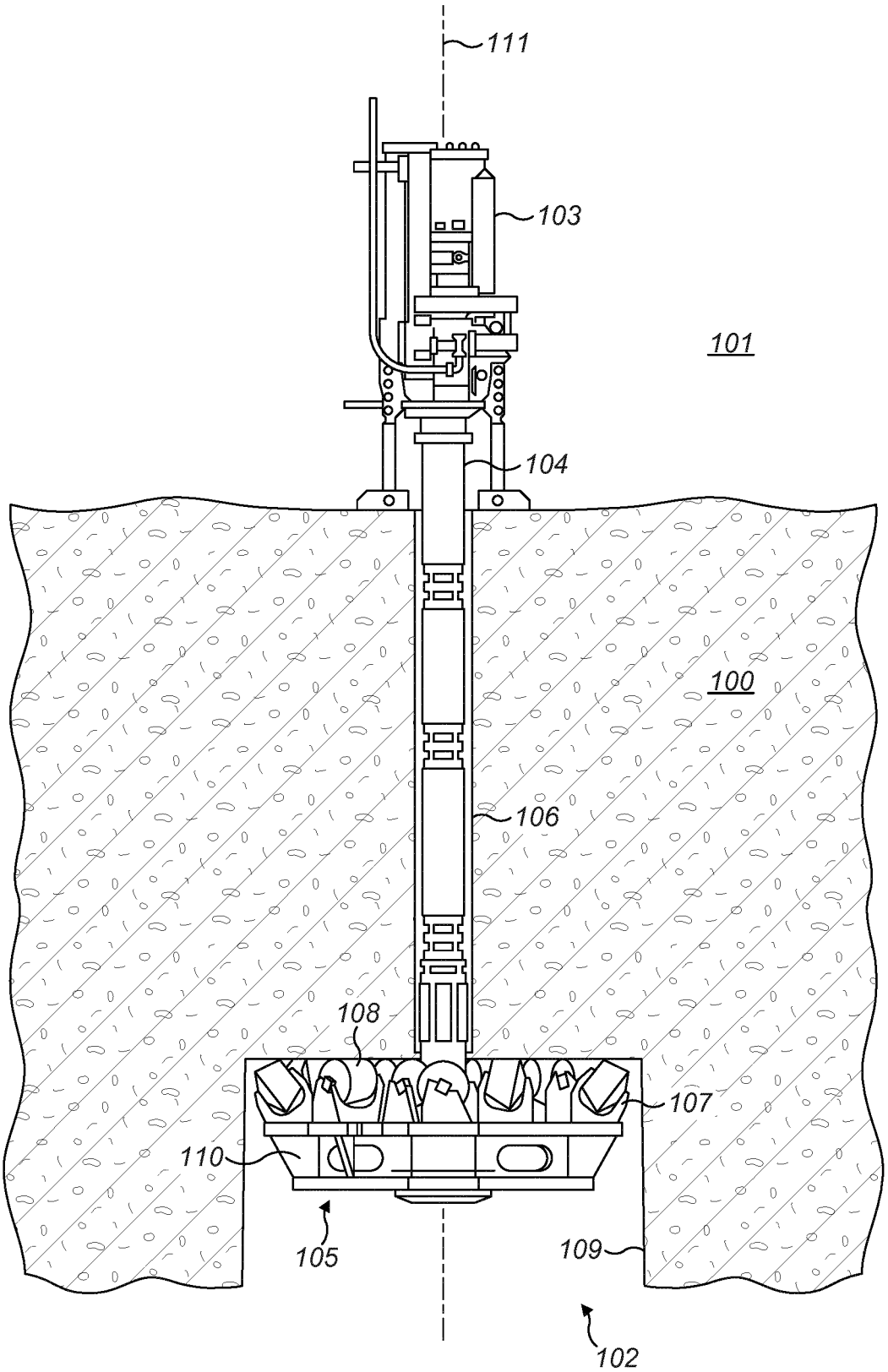
FIG. 1 is a schematic illustration of raise boring apparatus to create a borehole between a first and a second underground location using a boring head that mounts a plurality of roller cutters.

Referring to FIG. 1, raise boring apparatus comprises a raise boring head indicated generally by reference 105 mounted at one end of an elongate drive shaft 104 that is in turn rotatably driven by a drive rig 103. Rig 103 according to the example illustration is mounted at a first underground location 101 being separated from a second underground location 102 by a layer of rock 100. A pilot borehole 106 is formed within rock 100 as an initial pilot drilling operation using a pilot bit (not shown) attached to the end of drive shaft 104 (typically formed from end-to-end threaded rods). Following the creation of the pilot bore 106, the pilot bit is replaced at the end of the shaft 104 by raise boring head 105 having an appreciably larger diameter than the initial pilot bit so as to create a larger diameter bore 109. Both shaft 104 and boring head 105 are mounted centrally on longitudinal axis 111 such that the boring head 105 projects radially outward from axis 111 by a predetermined radius to achieve the desired diameter of bore 109. Boring head 105 comprises a main body 110 that mounts a plurality of saddles 107 that in turn mount respective roller cutters 108. As shaft 104 is rotated via rig 103, main body 110 is configured to rotate with each cutter 108 also rotating independently to cut into the rock 100 as the shaft 104 is retracted axially towards rig 103 and the boring head 105 raised vertically into the rock 100 from the second location 102 to first location 101.

Figure 2:
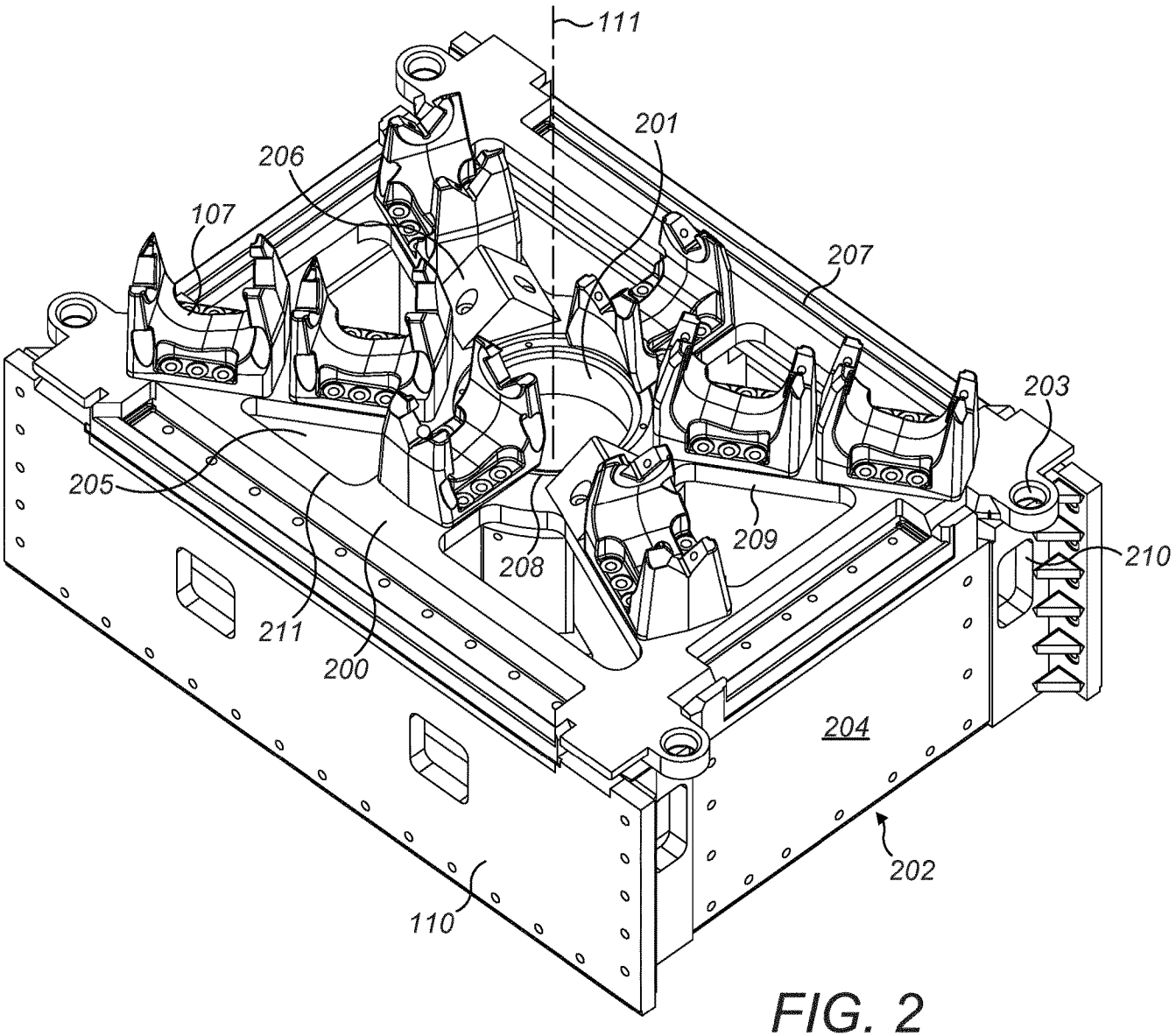
FIG. 2 is a perspective view of a main body of the boring head of FIG. 1 mounting a plurality of saddles that in turn mount the roller cutters (removed for illustrative purposes) and a pair of guide blocks to facilitate the discharge of cut material away from the boring head during cutting according to a specific implementation of the present invention.

Referring to FIG. 2, main body 110 is formed as an extendable or modular reaming head in which a central section provides a mounting for side extensions or wings (not shown). In particular, main body 110 comprises sidewalls 204 and respective attachment couplings 203, 210 positioned to secure the head extensions (not shown) against or opposed to sidewalls 204 so as to extend the diameter of the boring head 105 relative to axis 111. Main body 110 comprises a planar mount face indicated generally by reference 200 that comprises a cylindrical through bore 201 (defined by a circular opening 208 within mount face 200) centred on axis 111 and extending axially through the main body 110 from the mount face 200 to a rear face 202 that mounts drive shaft 104 at boring head 105. Mount face 200 also comprises a plurality of openings 211 distributed around central bore 201 that at least partially define channels 205 that also extend from mount face 200 to rear face 202. Channels 205 are open at both faces 200, 202 to allow the downward discharge (under gravity) of cut material from the mount face 200 to the rear face 202 to then fall below boring head 105. Accordingly, mount face 200 is divided into a plurality of spokes 209 extending radially from an outer perimeter edge 207 to the central bore 201.

Figure 3:
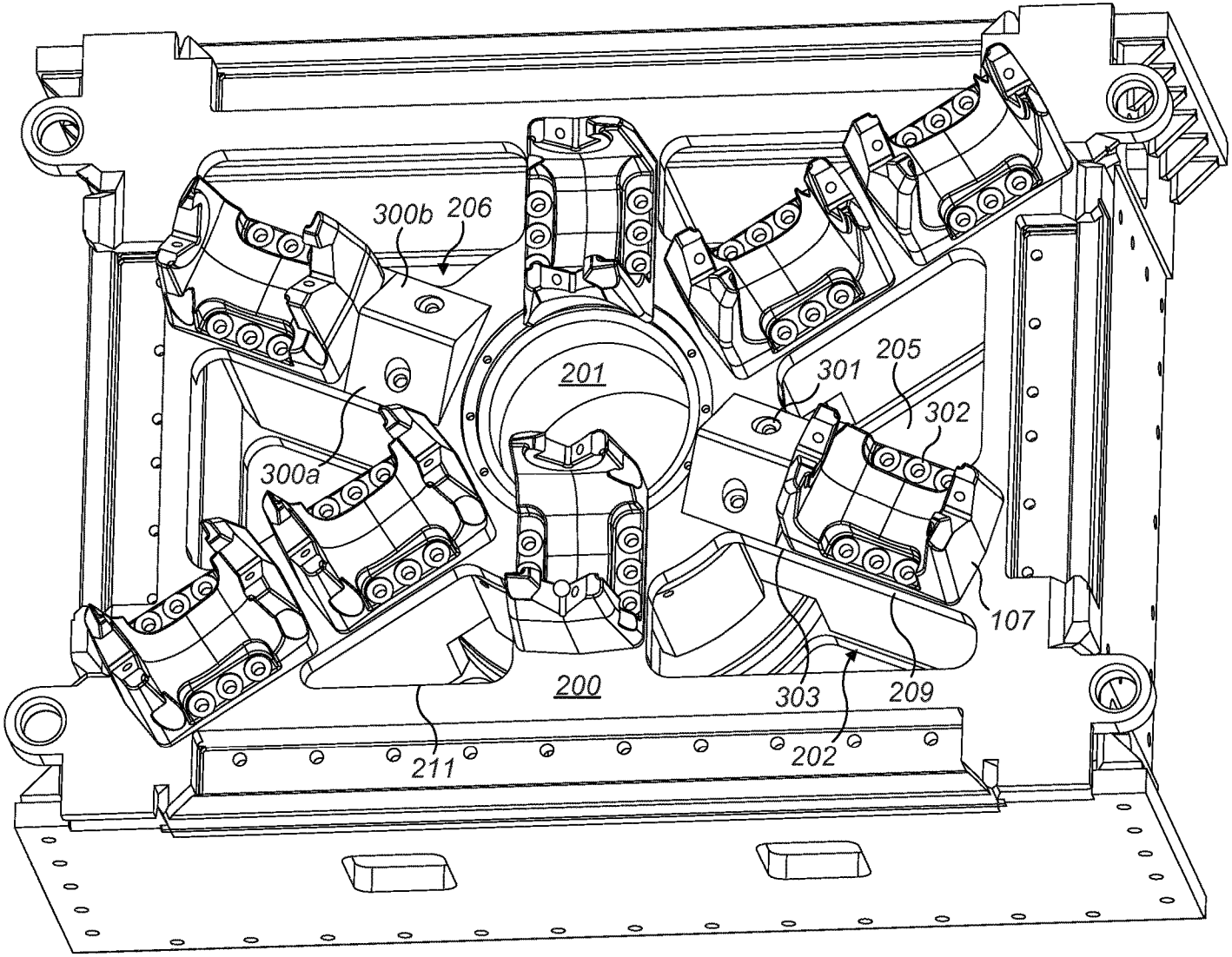
FIG. 3 is a magnified perspective view of the guide blocks and a mount face of the main body of FIG. 2.

Each spoke 209 provides a mounting region for one or a plurality of saddles 107 that each mount respectively a roller cutter 108 (removed from FIGS. 2 and 3 for illustrative purposes). Each saddle 107 projects upwardly from mount face 200 in a direction of axis 111 and drive shaft 104. According to the specific implementation, a guide block 206 is also attached to mount face 200 at a radially inner region of two diametrically opposed spokes 209. Guide blocks 206 are positioned radially inside respective saddles 107 so as to be positioned radially intermediate saddles 107 and central axis 111 (and drive shaft 104) during use.

Figure 4:
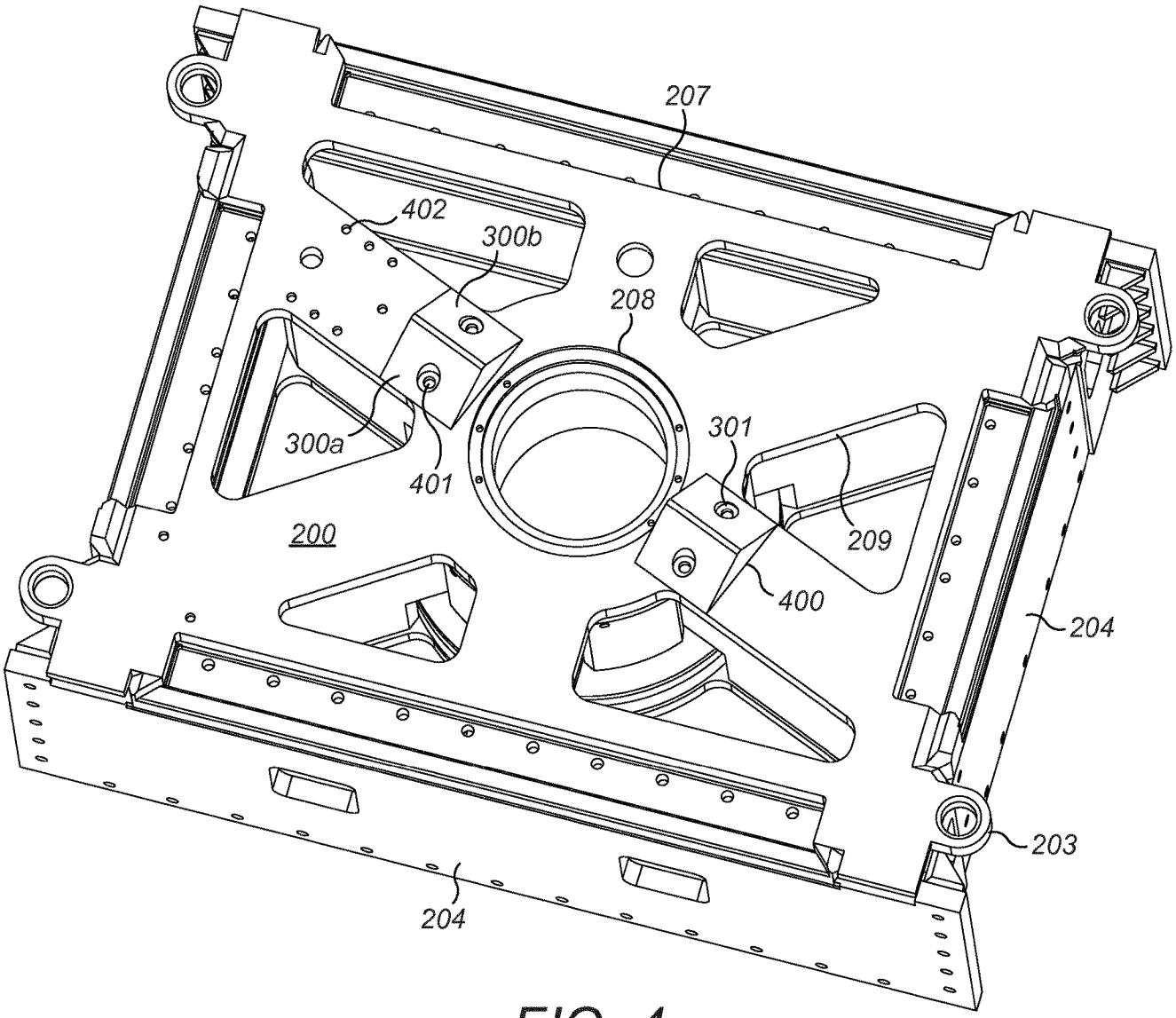
FIG. 4 is a further perspective view of the main body of FIG. 3 with the saddles removed for illustrative purposes.
Figure 5:
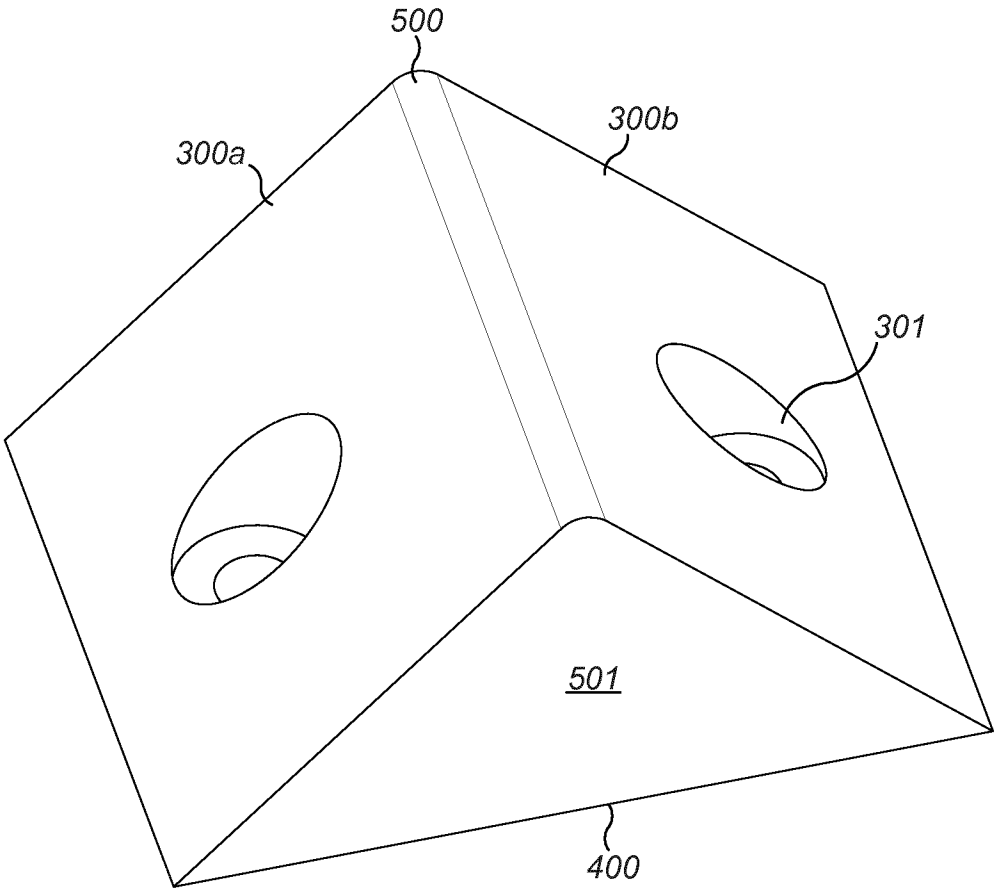
FIG. 5 is a perspective view of one of the guide blocks of FIG. 4.

Referring to FIGS. 3 to 5, each guide block 206 is formed as a single piece body in a form of a triangular prism having a base surface 400 mounted in contact with mount face 200 of main body 110. A pair of substantially planar inclined guide faces 300*a*, 300*b* project upwardly from base surface 400 and together define an apex or ridge 500. A pair of generally vertical side faces 501 extend perpendicular to the base surface 400 at each lateral side of the inclined guide faces 300*a*, 300*b*. Accordingly, with guide block 206 secured in position at mount face 200, guide faces 300*a*, 300*b* extend transverse to the generally horizontal planer mount face 200. According to the specific implementation, the elongate apex 500 is aligned with the radially extending spoke 209 on which the guide block 206 is mounted and also a corresponding rotational axis (also extending in a radial direction from axis 111) about which the roller cutter 108 is configured to rotate when mounted at saddle 107 positioned radially outside and adjacent guide block 206 on the same spoke 209. Accordingly, guide faces 300*a*, 300*b* are inclined upwardly from the lateral sides 303 of spoke 209 such that cut material is configured to slide downwardly over faces 300*a*, 300*b* to then fall into each channel 205 to each lateral side 303 of spoke 209.

Each guide block 206 comprises a pair of through bores 301 that extend from each respective guide face 300*a*, 300*b* to base surface 400 so as to receive attachment bolts (not shown) to releasably attach each guide block 206 to main body 110 via mount face 200. The bolts (not shown) are secured within threaded bores 401 extending axially into main body 110 from mount face 200. Corresponding threaded bores 402 are also provided on each spoke 209 so as to releasably attach saddle 107 via separate corresponding bolts received through respective bores 302 formed through a base region of saddle 107.

By configuring mount face 200 with a plurality of threaded bores 401, 402 at different locations, and via the appropriate attachment bolts (not shown) guide blocks 206 and saddles 107 are independently and interchangeably mounted at main body 110.

Figure 6:
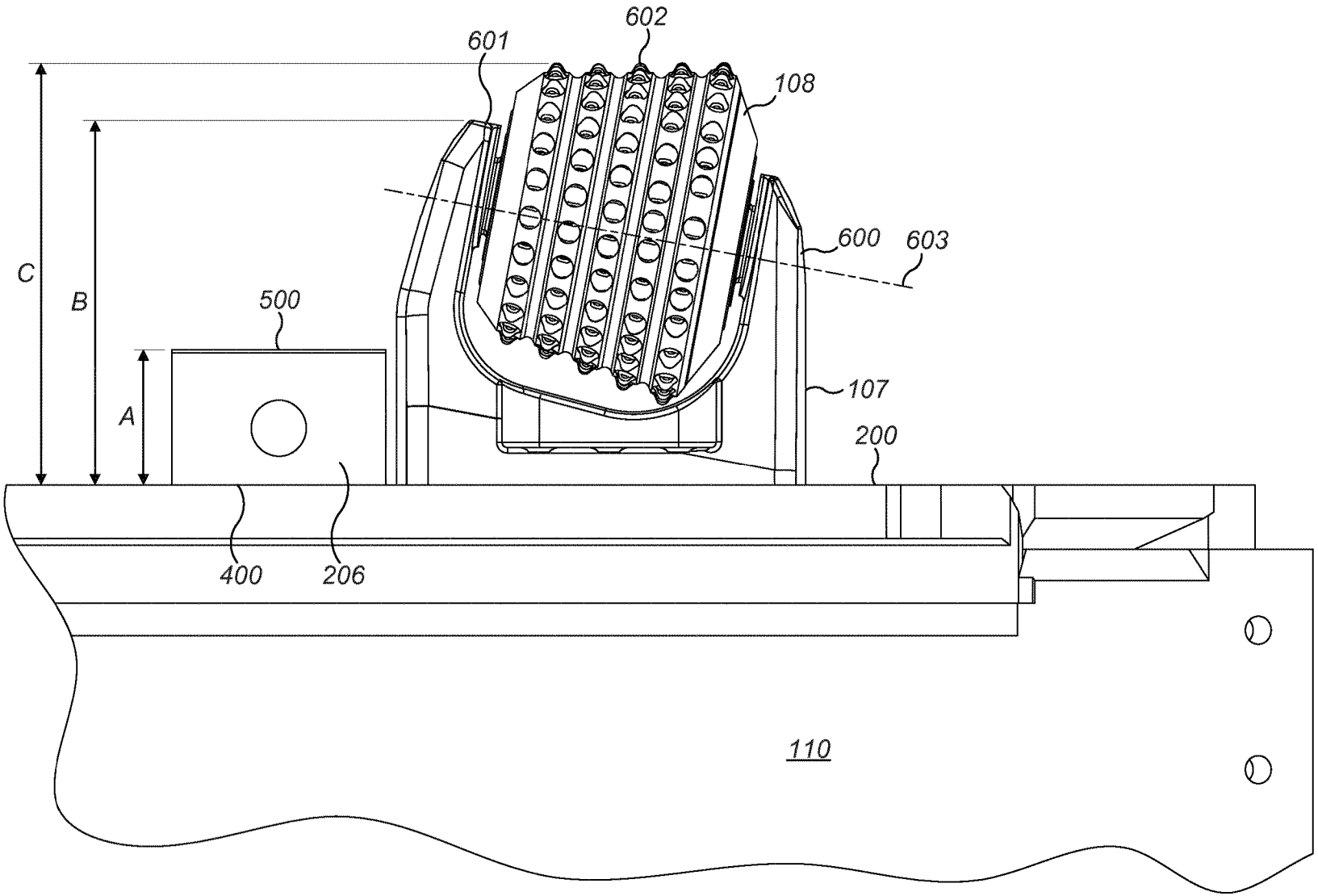
FIG. 6 is a side elevation view of one of the guide blocks, saddles and roller cutters attached to the mount face of the main body of FIG. 4.

Referring to FIG. 6, each guide block 206 projects upwardly from mount face 200 by a distance A corresponding to the vertical height of apex ridge 500 from mount face 200. Each saddle 107 comprises a pair of upstanding arms 600 to receive roller cutter 108 therebetween for rotation about axis 603. Each arm 600 comprises an uppermost end 601 that extends vertically above mount face 200 by a distance B. Roller cutter 108 comprises a plurality of cutting inserts 602 that represent the leading uppermost components of cutter 108 being configured to engage and cut the rock 100. Cutting inserts 602 are separated by a maximum distance C from mount face 200 as the cutter 108 rotates about axis 603. It is desirable that guide block 206 is mounted (in the axial height direction) below the uppermost cutting region of the cutters 108 and the uppermost end 601 of saddles 107 so as to avoid damage to the guide block 206 due to contact with the rock face 100 and a reduction in the cutting efficiency and boring rate of head 105. Accordingly, apex 500 is positioned in the lower half of the height of saddle 107 and significantly below the upper cutting region of cutter 108. In particular, distance A is approximately 30 to 40% of distance B and 25 to 37% of distance C. Additionally, according to the specific implementation, a length of guide blocks 206 is less than a corresponding length of each saddle 107 in a radial direction of spoke 209. In particular and according to the specific implementation, a length of guide block 206 is slightly greater than half of the length of saddle 107. According to the specific embodiment of FIGS. 2 to 6, guide blocks 206 are configured to prevent accumulation of debris at the radially inner region of the mount face 200 by directing the cut material into the channels 205 via guide faces 300*a*, 300*b*.

According to further specific embodiments, guide blocks 206 may comprise generally curved guide faces 300*a*, 300*b* where the curvature may be concave or convex in the axial direction perpendicular to mount face 200. Additionally, each guide block 206 may comprise a single guide face (300*a* or 300*b*) or may comprises a plurality of guide faces where the guide block is formed as a polyhedron. According to further embodiments, guide blocks 206 may be removably positioned towards the perimeter edge 207 so as to avoid the accumulation of debris material at the perimeter of the main body 110 and between the main body 110 and an extension body (not shown) attached at one or more of the sidewalls 204.

The present reaming head may comprise a plurality of the same of different shaped guide blocks 206 and may comprise a symmetrical or asymmetrical distribution of guide blocks 206 at mount face 200.

The invention claimed is:

1. A raise boring head for rotary boring in rock comprising:

a body arranged to be mounted at a drive shaft, the body having a planar mount face extending radially outward from the shaft;

a plurality of channels extending axially through the body from the planar mount face to a rear face of the body to divide the planar mount face into a plurality of spokes, each of the plurality of spokes having a first end adjacent the drive shaft;

a plurality of saddles provided on the spokes of the mount face adjacent the channels, the saddles being arranged to rotatably mount respective roller cutters at the body; and at least one guide block attached to at least one of the plurality of spokes and projecting from the planar mount face at a position between the first end of the at least one spoke and a respective saddle so as to be adjacent or spaced apart from the saddles, the at least one guide block having at least one guide face aligned transverse to the mount face and arranged to transport cut material away from the mount face, wherein the at least one guide block is separate from and formed non-integrally with the saddles.

2. The boring head as claimed in claim 1, wherein the at least one guide face is generally planar and inclined relative to the mount face or is curved relative to the mount face.

3. The boring head as claimed in 1, wherein the mount face extends generally perpendicular to the drive shaft.

4. The boring head as claimed claim 1, further comprising at least one attachment bolt to secure the at least one guide block to the mount face.

5. The boring head as claimed in claim 1, wherein the at least one guide block is secured to the mount face via weld material.

6. The boring head as claimed claim 1, wherein the at least one guide block projects from the mount face by a distance that is less than a distance by which at least some of the saddles project from the mount face.

7. The boring head as claimed claim 1, wherein the at least one guide block projects from the mount face by a distance that is less than a distance by which each of the roller cutters project from the mount face.

8. The boring head as claimed in claim 1, wherein the at least one guide block is positioned at the mount face adjacent an open end of a respective channel to deflect cut material into the channel for transport from the mount face to the rear face.

9. The boring head as claimed claim 1, wherein the at least one guide block is positioned at the mount face radially inside the saddles.

10. The boring head as claimed in claim 1, wherein the at least one guide block has a geometry of a triangular prism.

* * * * *